US010823478B2

(12) United States Patent
Williams

(10) Patent No.: US 10,823,478 B2
(45) Date of Patent: Nov. 3, 2020

(54) MODULAR THERMAL DEVICE

(71) Applicant: Benjamin S. Williams, Wrentham, MA (US)

(72) Inventor: Benjamin S. Williams, Wrentham, MA (US)

( * ) Notice: Subject to any disclaimer, the term of this patent is extended or adjusted under 35 U.S.C. 154(b) by 226 days.

(21) Appl. No.: 15/599,726

(22) Filed: May 19, 2017

(65) Prior Publication Data

US 2017/0336134 A1 Nov. 23, 2017

Related U.S. Application Data

(60) Provisional application No. 62/338,669, filed on May 19, 2016.

(51) Int. Cl.

| | |
|---|---|
| ***F25D 17/02*** | (2006.01) |
| ***F25D 11/00*** | (2006.01) |
| *F25D 3/08* | (2006.01) |

(52) U.S. Cl.

CPC ..... *F25D 11/006* (2013.01); *F25D 17/02* (2013.01); *F25D 3/08* (2013.01); *F25D 2201/14* (2013.01); *F25D 2331/803* (2013.01)

(58) Field of Classification Search

CPC ..... F25D 17/02; F25D 2331/083; F25D 2201/14; F25D 3/08; F25D 11/006

See application file for complete search history.

(56) References Cited

U.S. PATENT DOCUMENTS

| | | | | |
|---|---|---|---|---|
| 5,921,096 | A * | 7/1999 | Warren | F25D 15/00 62/185 |
| 2007/0186580 | A1* | 8/2007 | Kaplan | A23L 3/36 62/457.5 |
| 2015/0354886 | A1* | 12/2015 | Sinko | F25D 31/006 62/390 |
| 2017/0290741 | A1* | 10/2017 | Chou | F25D 3/005 |

* cited by examiner

*Primary Examiner* — David J Teitelbaum

(74) *Attorney, Agent, or Firm* — John J. Brooks, III; John Brooks Law LLC

(57) ABSTRACT

A modular cooling/heating device includes a thermal plant such as a micro-refrigeration system with an integrated heater for providing remote, on-site cooling/heating to an insulated enclosure defining a modular cooling volume by exchanging a liquid thermal-transfer medium, such as available tap water or alcohol-glycol mixture, with a thermal exchanger disposed within the insulated enclosure. A thermal source adapted for thermal exchange with a fluidic transfer medium combined with an engageable fluidic coupling between the thermal source and the thermal exchanger provides for detachable engagement of the thermal exchanger in a verity of contexts. The thermal exchange may take the form of a flexible, fluid carrying pouch, or a rigid thermal vessel having substantial vacuum and phase-change lining features for thermal inertia. Both may be combined with an integrated, insulated enclosure including the battery and thermal source as a combined, portable package.

22 Claims, 2 Drawing Sheets

MODULAR THERMAL DEVICE

RELATED APPLICATIONS

This application claims the benefit under 35 U.S.C. §119 (e) of U.S. Provisional Patent Application No. 62/338,669, filed May 19, 2016, entitled "MODULAR COOLING/HEATING DEVICE" incorporated herein by reference in entirety.

STATEMENT REGARDING FEDERALLY SPONSORED RESEARCH OR DEVELOPMENT

This invention was made with government support under matter No. NA-1451 of the Natick Soldier Research Development and Engineering Center (NSRDEC). The government has certain rights in the invention.

BACKGROUND

Refrigeration facilities are commonplace in most industrialized regions, however remote deployment of people and facilities can underscore contexts of imperative refrigeration. In military or tactical settings, for example, conventional stationary refrigeration units are unwieldly, and temporary thermal "buffers" such as ice and cold packs have limited longevity and increased bulk. Remote deployment can also position personnel at substantial distances from medical supplies, power, food and water. Vehicular access cannot be assumed at all times in a remote setting, so vehicular based cooling/heating containment may be ineffective in certain situations. In the case of a field injury, it may be imperative to transport refrigerated medical supplies, such as blood and IV (intravenous) fluids, as well as food and potable water, to a location accessible only by foot.

For example, in a desert or tropical tactical or deployment region, average ambient temperatures can be anywhere between 95° F. and 120° F. Under these conditions, heat-induced ailments can negatively affect warfighter combat effectiveness through reduced endurance and cognitive function. Drinking cold water (<70° F.) can drastically thwart off heat related ailments, as well as improve cognitive function and endurance. When compared to drinking warm water, cold water can increase exercise endurance capacity by 23±6%, as well as reduce heart rate and psychological strain.

It is also logistically difficult to provide warfighters in austere conditions who have succumbed to heat related ailments proper medical treatment on-site due to the high temperature of the on-site medical supplies. These negative side effects can prove detrimental to mission success, and in the worst case, prove to be a safety issue to warfighters who cannot receive on-site medical supplies (IV bags, etc.) at the proper temperatures (77° F.-98.6° F.). Conversely, warfighters in extremely cold climates can encounter safety issues when medical supplies reach temperatures below their required storage temperatures; rendering the supplies unusable. Examples of such heat-induced ailments include heat syncope, heat exhaustion, heat stroke, and dehydration.

SUMMARY

A modular cooling/heating device includes a thermal plant such as a micro-refrigeration system with an integrated heater for providing remote, on-site cooling/heating to an insulated enclosure defining a modular cooling volume by exchanging a liquid thermal-transfer medium, such as available tap water or alcohol-glycol mixture, with a thermal exchanger disposed within the insulated enclosure. The cooling/heating plant includes a DC powered refrigeration apparatus integrated with a heater and a liquid pump for cooling/heating the thermal-transfer medium and pumping the cooled/heated water to the thermal exchanger by a system of engageable fluidic couplings including flexible tubes or hoses. The thermal plant may be run from a DC battery or any suitable DC power source, and optionally solar charged. The insulated enclosure employs thermal barriers for increasing a thermal inertia of the interior volume of the insulated enclosure.

Configurations herein are based, in part, on the observation that tactical and remote environments impose particular demands on environmentally controlled storage, specifically maintaining refrigeration of medicinal and perishable items in an arid, desert environment. Remote locations have limited electrical access, often only via on-site generation. Unfortunately, conventional approaches to portable refrigeration suffer from the shortcoming that battery longevity for maintaining refrigeration capability, combined with variability of ambient temperatures which can impose substantial refrigeration demands, limiting an available refrigeration duration at a prescribed maximum temperature. Certain medicinal items, such as blood and blood plasma, require continuous refrigeration below 10° C., for example. Discontinuity in refrigeration can render a medicinal supply unusable. In a tactical, battlefield, or reconnaissance situation, variation in such refrigeration can render an in-process mission terminated. Perhaps even more importantly, in the case of reliance on the compromised supply, the intended recipients of the medicinal supply may be endangered.

Accordingly, configurations herein substantially overcome the shortcomings of unreliable refrigeration by providing a portable, self-contained refrigeration apparatus including a thermal vessel adapted to receive direct cooling combined with thermal inertia for maintaining a target cooling temperature. The thermal vessel resides in the interior of an insulated enclosure integrated with a power supply and thermal source, but may operate independently.

Conventional portable refrigeration systems lack efficiency and performance since they primarily use air as their medium for cooling. In contrast the disclosed approach uses a liquid medium which can, in some instances, be in direct contact with the items to be cooled. This increases the system's efficiency and performance characteristics. A thermal source may employ high-pressure refrigeration gases which are used for cooling. Such gases are contained within a ruggedized micro-refrigeration system and not plumbed throughout the larger refrigeration system, which lends itself towards making the system extremely rugged. In contrast, other refrigeration systems which pump high-pressure refrigeration into a heat exchanger in a modular cooling volume would be less rugged due to the rigidity of the tubing needed. Any crack or break would render the system inoperable. Systems which use high-pressure lines are also not modular or able to disconnect from their cooling volumes as any loss of a high pressure refrigeration medium (i.e. R134a, R22, R400, etc. renders the system inoperable In further detail the modular thermal device disclosed herein includes a thermal vessel having a thermally insulated casing surrounding a storage volume, such that the thermally insulated casing has a thermal transfer chamber, a vacuum chamber, and a phase change layer. The thermal transfer chamber has a plurality of ports for exchanging a transfer medium such as cooled water to conduct heat between the storage volume and a thermal source. The transfer medium is defined by a liquid throughout transport between the thermal source and the thermal exchanger, in contrast to conventional cooling systems which alternate phase between a liquid and gas for thermal transfer.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Configurations below depict several configurations of an example modular cooling volume suitable for use with configurations herein. A thermal source adapted for thermal exchange with a fluidic transfer medium combined with an engageable fluidic coupling between the thermal source and the thermal exchanger provides for detachable engagement of the thermal exchanger in a verity of contexts. The thermal exchange may take the form of a flexible, fluid carrying pouch, or a rigid thermal vessel having substantial vacuum and phase-change lining features for thermal inertia. Both may be combined with an integrated, insulated enclosure including the battery and thermal source as a combined, portable package.

Figure 1:
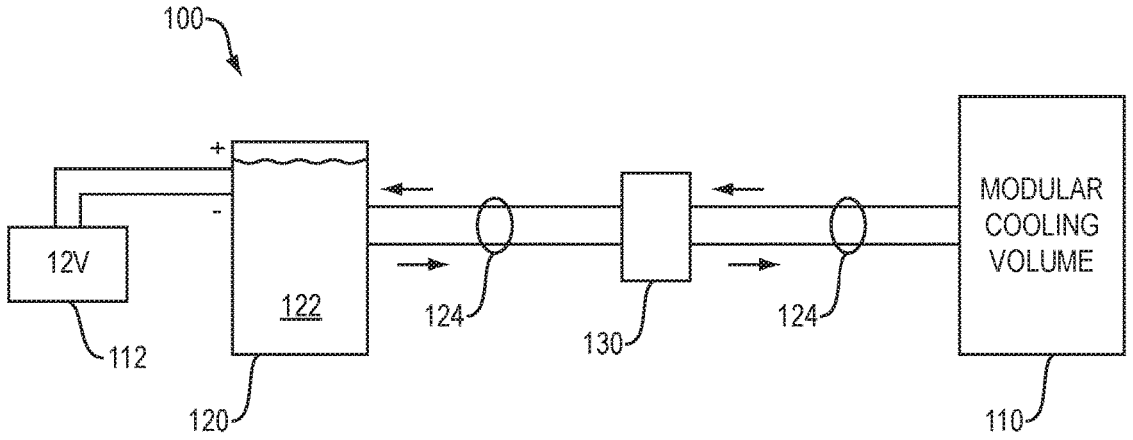
FIG. 1 is a context diagram of a portable refrigeration apparatus suitable for use with configurations herein.

FIG. 1 is a context diagram of a portable refrigeration apparatus suitable for use with configurations herein. Referring to FIG. 1, in an ambient environment 100, a modular cooling volume 110 is cooled by a thermal source 120. In the discussion herein, the thermal flow is described in terms of a cooling operation, in which it is desirable to maintain the modular cooling volume at a temperature lower than an ambient temperature in the ambient environment 100. Configurations discussed below depict an arid setting, such as might be encountered in desert tactical environments, and hence it is desirable to maintain cooled items, such as water, medicine and blood. The same principles could be applied to heating a modular volume 110' in an artic or cold ambient environment.

The thermal source 120 delivers a liquid transfer medium 122 for exchanging heat from the modular cooling volume 110. Bidirectional transfer tubes 124 deliver the transfer medium 122 to and from the modular cooling volume 110. The transfer medium 122 may be fulfilled by water, as water has ideal thermal conduction properties and will not freeze in a refrigeration (above 0° C.) setting, as is typically expected of the thermal source 120. Alternatively, other liquid cooling mediums may be employed, such as a solution for lowering the freezing point of water. It should be noted, however, that the low pressure operation of the modular cooling volume 110 and transfer tubes 124 benefit from avoiding the need for a pressurized gaseous medium and high pressure components. Cooled water or other low-pressure liquid transfer medium 122 emanates from the fluid source 120. In the event that the thermal source includes evaporative refrigerant, such refrigerant is entirely contained within the thermal source 120 and need not be plumbed throughout the cooling volume 110.

The modular cooling volume 110 may take a variety of forms, and interchanges using an engageable fluid coupling 130. The engageable fluid coupling 122 sealably engages both sides (tubes) of the transfer tubes 124. The engageable fluid coupling 130 may be integrated with the modular cooling volume 110 in a variety of configurations, discussed further below.

Power is provided by a rechargeable lithium ion battery 112 having suitable capacity and portability. A typical battery size may be around 300 watt hours.

A battery operated cooling/heating plant, or micro-fridge/heater, attached to a ruggedized outer pack or storage containment, forms the base of the remotely deployable modular cooling/heating apparatus. The modular cooling/heating apparatus as disclosed herein includes a cooling/heating plant adapted for thermal exchange with a fluidic medium, and a thermal exchanger receptive to a flow of the fluidic medium and adapted for fluidic exchange with the cooling plant. An insulated enclosure having the thermal exchanger disposed therewithin has an interior volume for containing a cooled/heated payload. The engageable fluidic coupling between the cooling plant and the thermal exchanger is adapted for transport of the cooling medium between the cooling plant and the thermal exchanger. Depending on the configuration, a plurality of engageable fluidic couplings are operable for directing the cooling medium through one or more insulated enclosures, such as for disposing a smaller backpack like insulated enclosure inside a larger insulated enclosure, which allows for storing additional payloads which may or may not be actively cooled/heated by the cooling/heating plant, i.e. water, IV bags, etc. The insulated enclosure and any subsequent larger enclosures employ an outer polychromatic coating which is capable of reflecting infrared radiation. This polychromatic layer increases the thermal resistance of the insulated enclosures when exposed to sunlight or placed near hot surfaces.

In contrast to conventional refrigeration systems, where a refrigerant such as R134a or related compounds alternate between a liquid and a gas under high pressure, the fluidic thermal transfer medium is of relatively low pressure during transport between the cooling plant and the thermal exchanger. Since the fluidic medium flows through low pressure vessels or tubes, a selectively engageable fluidic coupling allows for detachment of the thermal exchanger without any loss of R134a refrigerant for the cooling/heating plant. Therefore, the thermal exchanger may couple/decouple as many times as necessary to/from the cooling/heating plant by a plurality of selectively engaging bidirectional fluidic couplings, permitting the insulated enclosure to be disposed in any number of larger insulated enclosure or other configurations while maintaining a liquid tight seal on all fluidic vessels as well as the thermal exchanger and cooling/heating plant. Further, since the thermal medium is fluid based and said fluid is not under pressure when the system is not in operation, incidental fluid loss may be easily replaced.

In a configuration where the cooling medium (water or alcohol/glycol) isn't accessible at the modular cooling volume, as with a vacuum insulated vessel (discussed below), any suitable portion of tubing in the cooling medium circuit (generally a tubing loop) is responsive to disconnection at any junction for insertion of a purge/fill assembly. Such a purge/fill assembly may be as basic as a jar with a screw cap on the top such that one of the coolant lines goes into the lid and the other extends to the bottom of the jar to draw the cooling medium into the cooling/heating plant and subsequent system. This allows one to access the flow within the system and add/remove liquid.

In an example arrangement, the thermal exchanger includes a fluid bladder having flexible sides and a deformable shape adapted for conformance to an interior of the insulated enclosure, and a plurality of fluidic couplings operable for bidirectional exchange of the fluidic medium between the cooling plant and the thermal exchanger. The fluid bladder may include receptacles adapted to receive containers of payload items to be cooled/heated, to increase surface area contact of the cooling medium with payload items (such as water bottles).

Figure 2A:
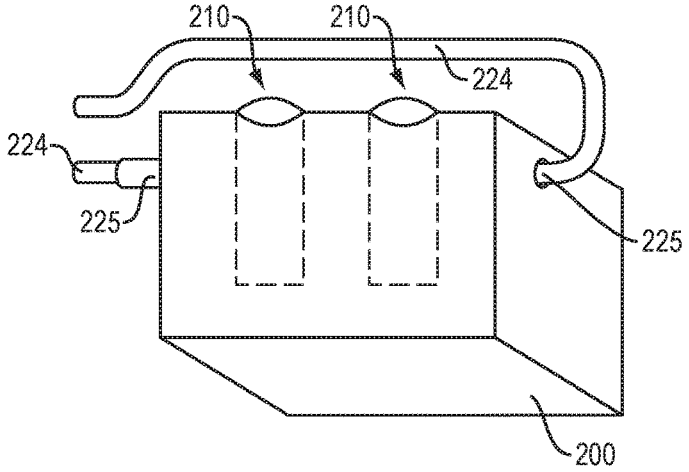
FIGS. 2A-2B show a flexible thermal exchanger in the modular cooling volume of FIG. 1.
Figure 2B:
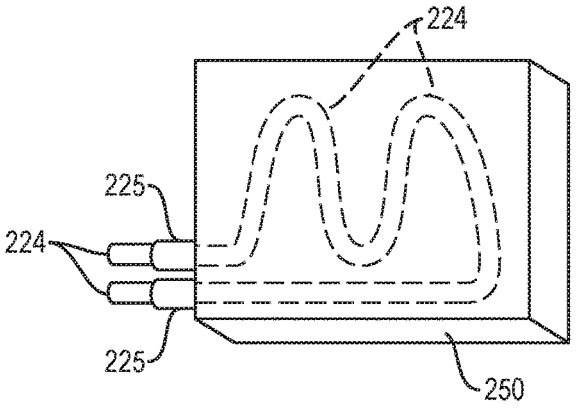

FIGS. 2A-2B show a flexible thermal exchanger in the modular cooling volume of FIG. 1. Referring to FIGS. 1-2B, in FIG. 2A a fluid bladder 200 employing fluidic tubes 224 contains the transfer medium 122 cooled and pumped from the thermal source 120. The fluidic tubes 224 complete an input and output flow, respectively, from the transfer tubes 124 via ports 225.

The fluid bladder 200 employs recesses 210 sized for receiving water bottles or similar container. The entire fluid bladder 200 is intended to be disposed in the larger insulated enclosure for providing cooling capability to an interior of the enclosure, discussed further below in FIG. 4. This feature is illustrative of an advantage of a low pressure liquid transfer medium 122. Any suitable fluid receptacle adapted to receive a liquid flow may be employed as the fluid bladder 200 or modular cooling volume 110. The fluid bladder 200 may also be opened and the water bottles can be directly immersed in the fluid for even better heat transfer performance.

The liquid transfer medium 122 flows at a pressure substantially below a gaseous cooling medium in an evaporative refrigeration system. Hence, the fluid bladder 200 need not withstand high pressures of evaporative refrigerant (typically anywhere between 50-500 psi), allowing construction of flexible plastic. Pressure need only be sufficient to force water or a water solution transfer medium through the tubes 124 and fluid bladder 200 or other thermal exchanger. The liquid transfer medium 122 remains in a single liquid phase and below 25° C., down to just above freezing (i.e. 1° C.), for water or similar solution, for maintaining cooling. In a heating context, the liquid transfer medium may be around 83° C. Other fluids used as the transfer medium 122 may have analogous ranges. For example, a glycol/alcohol mixture may be cooled to −18 C.

Alternatively, a cooling panel 250 defines the thermal exchanger in the modular cooling volume 110. FIG. 2B shows a cooling panel 250 including a planar, flexible shape, in which the fluidic tubes 224 are integrated in or layered between flexible plastic. The tubes 224 traverse the area of the panel in a series of "S" curves and/or parallel arrangement for increasing tubular area. The cooling panel 250 may be placed in the bottom of the insulated enclosure or wrapped around or over items in the insulated enclosure.

The disclosed insulated enclosure and thermal exchanger pouch are suitable for providing refrigerated storage for perishable, water, and medicinal items for a duration of battery longevity and for a time thereafter. However, in a further embodiment, the insulated enclosure takes the form of a rigid thermal vessel employing a vacuum insulated region and phase change material, which, when coupled with the thermal source, provides an extended duration of refrigeration throughout extreme ambient heat and without external charging.

Figure 3A:
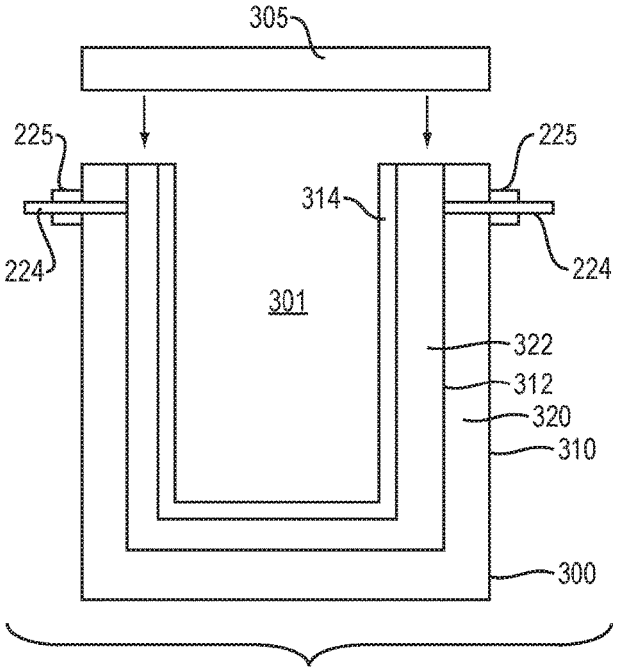
FIGS. 3A-3C show a rigid vessel thermal exchanger in the modular cooling volume of FIG. 1.
Figure 3B:
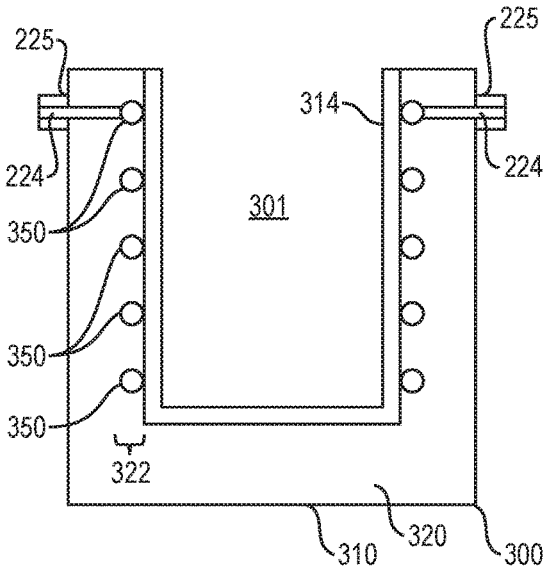
Figure 3C:
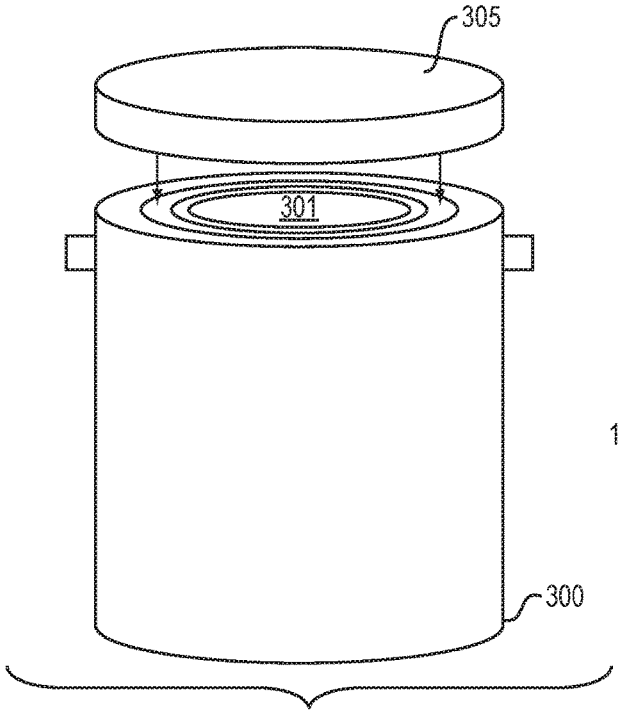

FIGS. 3A-3C show a rigid vessel thermal exchanger comprising the modular cooling volume 110 of FIG. 1. Referring to FIGS. 3A and 3B, the thermal vessel 300 defines a layered encapsulation around the storage volume for storing refrigerated items, and is constructed of a rigid metal such as stainless steel. The thermal enclosure 300 includes a vacuum layer 310 defined by the vacuum chamber 320, in which the vacuum layer 310 has an insulating void 320 for maintaining thermal inertia, a thermal transfer layer 312 defined by the thermal transfer chamber 322, in which the thermal transfer layer is configured for fluidic flow of the transfer medium 122 between the plurality of ports 225, and a phase change layer 314 having a phase change material. A lid 305 of similar constructing engages the thermal vessel 300 via threaded, clamped, or other suitable mechanism.

Any suitable arrangement of the layers 310, 312 and 314 may be employed, however in the example arrangement, the thermal vessel 300 disposes the phase change layer 314 at an innermost position and adjacent the storage volume 301, disposes the vacuum layer 310 in an outermost position, and the thermal transfer layer 312 between the phase change layer 314 and the vacuum layer 310. A stainless steel layer may form the interior of the cooling volume.

The thermal transfer layer 312 may be an open chamber for receiving the transfer medium 122, as depicted in FIG. 3A. Alternatively, an arrangement of elongated vessels or tubes may be employed. In FIG. 3B, the thermal transfer layer 312 includes a tubular array 350 surrounding the storage volume 301, through which the transfer medium 122 flows. In either the tubing array 350 or the continuous chamber 322, the liquid transfer medium flows in to the cooling volume 110 as cooled water, absorbs heat, and expels heat through the thermal source from the return flow. The phase change layer 314 increases thermal inertia, such that the phase change layer 314 absorbs substantial heat after being cooled below a particular range based on the properties of the phase change material. In the example configuration, the phase change material is most responsive between 4°-5° C., just above the freezing point of a water based transfer medium. In the particular case of blood plasma, for example, once cooled below 4° C., the phase change material will absorb substantial heat before rising above 4° C.

The phase changer material operates best when the transfer medium is in contact with the phase change material, or when the tubes are in contact with the phase change material for facilitating a re-freeze of the phase change material.

Suitable phase change materials (PCMs) include salt hydrate based positive temperature PCMs, having a freeze and melt at temperatures above 0 C (32 F). An alternate phase change material range would be phase change material which is rated between 7-8 C, and which could employ a smaller refrigeration system.

In operation, to leverage the thermal inertia of the phase change layer, the approach includes pre-freezing the thermal vessel 300 vacuum chamber before use at around 0 F (−18 C), for example, using a phase change material of the 4-5 C kind. This freezes the phase change material and provides a significant extension of storage time during operation. During deployment, re-freezing the phase change material would not be needed, as this would consume substantial power. Rather, the thermal vessel 300 cycles between 6-10 C. as an optimal range, this reduces the system's run time per cycle. However, refreezing of the PCM is attainable with a larger refrigeration unit and/or additional batteries or hardwiring of the system to a continuous power source. PCMs of the disclosed 4-5° C. range or—PCMs with 7-80° C. properties could be employed, for either an initial freeze or cyclic freezing.

A solar panel or flexible solar panel may be used to charge the system's battery while the system is in operation or in an idle mode via a digital charge controller to extend the operational time of a single battery. Said flexible solar panel may be attached to the system's insulated enclosure in a plurality of ways and may also be used to shade from solar radiation during operation.

The heating/cooling plant's operation may be automated via a digital controller and thermocouple sensors which monitor the cooling/heating medium and or the thermal vessel 300 vacuum chamber's internal temperature. Said digital controller can also display in real-time the temperature readings from the thermocouples.

FIG. 3C shows a perspective view of the rigid thermal vessel 300, cooled volume 301 and lid 305.

Figure 4:
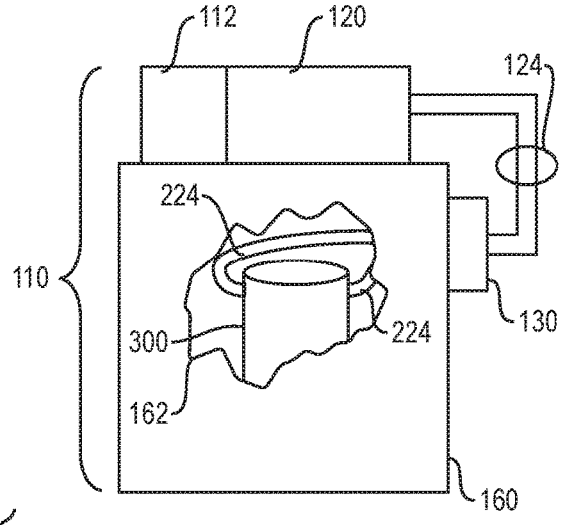
FIG. 4 shows the rigid vessel disposed in a transportable pack.

FIG. 4 shows the rigid vessel disposed in a transportable pack including the insulated enclosure 160 as the modular cooling volume 110. The transportable pack disposes the battery 112 and thermal source 120 in close proximity and within reach of the transfer tubes 124. The engageable fluidic coupling 130 passes through the exterior of the insulated enclosure 160 for connection to a transfer element such as the cooling pouch 200, cooling panels 250, or thermal vessel 300, shown by cutaway 162. The volume within the insulated enclosure may be used for cooling from the transfer medium 122, and the thermal vessel 300 employed for greater longevity and/or for particularly temperature sensitive items. In an example arrangement, the thermal vessel maintains a temperate between 4°-10° C. for 10 days. at an ambient outside temperature of 105° F., as might be encountered in a desert environment, however various combinations of temperature and longevity are available based on power and the thermal source, detailed below in TABLE I and TABLE II below.

TABLE I

| Ambient Temperature Day (8 Hours) Night (16 Hours) | Sunlight at 1000 W/M^2 On System | Time Capable of storing 1 Liter of Liquid below 50 F. | 62 Watt Solar Panel in use during daylight hours | Anticipated Storage time of 1 Liter of liquid below 50 F. if solar panel used | Battery used | Cooling Unit Power Draw |
|---|---|---|---|---|---|---|
| 95° F.-85° F. | Yes | 80 Hours | No | 112 | 300 W/Hrs | 100 W |
| 95° F.-85° F. | No | 112 Hours | YES | 80 | 300 W/Hrs | 100 W |
| 115° F.-95° F. | Yes | 60 Hours | No | 84 | 300 W/Hrs | 100 W |
| 135° F.-105° F. | Yes | 30 Hours | No | 42 | 300 W/Hrs | 100 W |

Table I shows testing results based on the thermal vessel 300 being tested under various diurnal cycles. Various parameters may be extrapolated, for example doubling the battery capacity would double the runtime. Typical battery runtime (300 W/Hrs) is around 4 hours. Anticipated storage times where the solar panel could be used are derived from test results where the solar panel was used.

TABLE II

| Ambient Temperature | Time to Cool 2 Liter of uncirculated liquids (IV BAG/bottled water, etc) AND 1 Gallon of circulated liquid to 98 F. from ambient starting temp | LOWEST TEMP of Circulated liquid achievable and in what timeframe | Battery used | Cooling Unit Power Draw |
|---|---|---|---|---|
| 95° F. | 8 MIN | 219 MIN to 49 F. | 300 W/Hrs | 100 W |
| 110° F. | 11 MIN | 190 MIN to 56.6 F. | 300 W/Hrs | 100 W |
| 120° F. | 15 MIN | 180 MIN to 61 F. | 300 W/Hrs | 100 W |

Table II depicts various parameters and effects on performance of the fluid bladder 200 configuration above.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. A refrigeration apparatus having high thermal inertia for cooling longevity, comprising:

a thermal source adapted for thermal exchange with a fluidic transfer medium;

a thermal exchanger receptive to a flow of the fluidic transfer medium and adapted to exchange the fluidic transfer medium with the thermal source;

the fluidic transfer medium is in a liquid state throughout transport to and from the thermal source and the thermal exchanger;

an insulated enclosure adapted to store the thermal exchanger;

an engageable fluidic coupling between the thermal source and the thermal exchanger for detachable engagement of the thermal exchanger from the thermal source;

the thermal exchanger comprises a first thermal exchanger;

the first thermal exchanger comprising a modular thermal device comprising:

a thermal vessel having a thermally insulated casing surrounding a storage volume, the thermally insulated casing having a thermal transfer chamber, a vacuum chamber, and a phase change layer, and the thermal transfer chamber having a plurality of ports for exchanging the fluidic transfer medium to conduct heat between the storage volume and the thermal source;

the first thermal exchanger configured to be coupled to the thermal source with the engageable fluidic coupling to the thermal source;

the thermal vessel and the engageable fluidic coupling are adapted for low pressure transfer of the fluidic transfer medium;

the thermal vessel defines a layered encapsulation around the storage volume, further comprising:

the phase change layer having a phase change material, a thermal transfer layer defined by the thermal transfer chamber, the thermal transfer layer configured for fluidic flow of the fluidic transfer medium between the plurality of ports, and a vacuum layer defined by the vacuum chamber, the vacuum layer having an insulating void for maintaining thermal inertia; and the refrigeration apparatus further comprises a battery configured to power the thermal source and maintain the thermal vessel at a temperature range between 4° C. and 10° C. for a period of 10 days.

2. The refrigeration apparatus of claim 1 wherein the thermal exchanger comprises a modular thermal device, the modular thermal device, comprising:

a thermal vessel having a thermally insulated casing surrounding a storage volume, the thermally insulated casing having a thermal transfer chamber, a vacuum chamber, and a phase change layer, and the thermal transfer chamber having a plurality of ports for exchanging the fluidic transfer medium to conduct heat between the storage volume and the thermal source.

3. The refrigeration apparatus of claim 2 wherein the fluidic transfer medium flows at a pressure substantially below a gaseous cooling medium in an evaporative refrigeration system.

4. The refrigeration apparatus of claim 2 wherein the thermal vessel defines a layered encapsulation around the storage volume, further comprising:

the phase change layer having a phase change material;

a thermal transfer layer defined by the thermal transfer chamber, the thermal transfer layer configured for fluidic flow of the fluidic transfer medium between the plurality of ports; and a vacuum layer defined by the vacuum chamber, the vacuum layer having an insulating void for maintaining thermal inertia.

5. The refrigeration apparatus of claim 4 wherein the thermal transfer layer includes a tubular array surrounding the storage volume.

6. The refrigeration apparatus of claim 4 wherein the phase change material absorbs heat after being cooled to a range between 4°-5° C.

7. The refrigeration apparatus of claim 4 wherein the thermal vessel maintains a temperature between 4°-10° C. for 10 days.

8. The refrigeration apparatus of claim 1 wherein the thermal exchanger is a flexible thermal vessel having a layered construction.

9. The refrigeration apparatus of claim 1 wherein the thermal exchanger has rigid construction for defining a vacuum enclosure jacket around a storage volume and is adapted for receiving a PCM (phase change material) coating.

10. The refrigeration apparatus of claim 1 wherein the thermal exchanger includes at least one of a:

thermal dissipater, thermal transfer chamber, and a modular volume.

11. The refrigeration apparatus of claim 1 wherein the thermal exchanger and the engageable fluidic coupling are adapted for low pressure transfer of the fluidic transfer medium.

12. The refrigeration apparatus of claim 1 further comprising a single 300 Watt Hour battery configured to power the thermal source and maintain a storage volume at a temperature range between 4° C. and 10° C. for a period of 10 days.

13. The refrigeration apparatus of claim 1 further comprising powering the thermal source from a DC power source while the thermal source is operating.

14. The refrigeration apparatus of claim 1 wherein:

the insulated enclosure is configured to be a person-portable insulated enclosure with an outer polychromatic coating;

the thermal source is powered by a battery whereby the refrigeration apparatus may be configured to be person-portable; and the battery and the thermal source are disposed outside of the insulated enclosure.

15. The refrigeration apparatus of claim 1 wherein:

the refrigeration apparatus is configured to be a person-portable insulated enclosure;

the fluidic transfer medium is transported between the thermal source and the thermal exchanger within one or more flexible transfer tube whereby the flexible transfer tube connects the thermal source and the thermal exchanger; and the thermal exchanger and the engageable fluidic coupling are adapted for low pressure transfer of the fluidic transfer medium.

16. The refrigeration apparatus of claim 1 wherein the thermal source comprises one from the group consisting of:

a heat source for the fluidic transfer medium; and a cooling source for the fluidic transfer medium.

17. The refrigeration apparatus of claim 1 wherein the thermal source comprises:

a heat source for the fluidic transfer medium; and a cooling source for the fluidic transfer medium.

18. The refrigeration apparatus of claim 1 wherein the thermal source comprises a heat source for the fluidic transfer medium.

19. The refrigeration apparatus of claim 1 wherein the thermal source comprises a cooling source for the fluidic transfer medium.

20. A refrigeration apparatus having high thermal inertia for cooling longevity, comprising:

a thermal source adapted for thermal exchange with a fluidic transfer medium;

a thermal exchanger receptive to a flow of the fluidic transfer medium and adapted to exchange the fluidic transfer medium with the thermal source;

the fluidic transfer medium is in a liquid state throughout transport to and from the thermal source and the thermal exchanger;

an insulated enclosure adapted to store the thermal exchanger;

an engageable fluidic coupling between the thermal source and the thermal exchanger for detachable engagement of the thermal exchanger from the thermal source;

the thermal exchanger comprises a fluid bladder comprising:

a flexible thermal vessel having one or more flexible sides, a plurality of fluidic couplings configured for bidirectional exchange of the fluidic transfer medium to the flexible thermal vessel, one or more recess to define a storage volume for a container, one or more opening configured to define the storage volume and allow the container to be directly immersed in the fluidic transfer medium, and the one or more opening being closeable whereby the thermal exchanger may retain the container and the fluidic transfer medium at any orientation;

the thermal exchanger configured to be coupled with the thermal source by the engageable fluidic coupling;

the flexible thermal vessel and the engageable fluidic coupling are adapted for low pressure transfer of the fluidic transfer medium; and the refrigeration apparatus further comprises a battery configured to power the thermal source and maintain the flexible thermal vessel at a temperature range between 4° C. and 10° C. for a period of 10 days.

21. The refrigeration apparatus of claim 20 wherein the battery comprises a single 300 Watt Hour battery configured to power the thermal source and maintain the flexible thermal vessel at a temperature range between 4° C. and 10° C. for a period of 10 days.

22. A refrigeration apparatus having high thermal inertia for cooling longevity, comprising:

a thermal source adapted for thermal exchange with a fluidic transfer medium;

a thermal exchanger receptive to a flow of the fluidic transfer medium and adapted to exchange the fluidic transfer medium with the thermal source;

the fluidic transfer medium is in a liquid state throughout transport to and from the thermal source and the thermal exchanger;

an insulated enclosure adapted to store the thermal exchanger;

an engageable fluidic coupling between the thermal source and the thermal exchanger for detachable engagement of the thermal exchanger from the thermal source;

the thermal exchanger is selected from the group consisting of a first thermal exchanger and a second thermal exchanger;

the first thermal exchanger comprising a modular thermal device comprising:

a thermal vessel having a thermally insulated casing surrounding a storage volume, the thermally insulated casing having a thermal transfer chamber, a vacuum chamber, and a phase change layer, and the thermal transfer chamber having a plurality of ports for exchanging the fluidic transfer medium to conduct heat between the storage volume and the thermal source;

the second thermal exchanger comprising a fluid bladder comprising:

a flexible thermal vessel having one or more flexible sides, a plurality of fluidic couplings configured for bidirectional exchange of the fluidic transfer medium to the flexible thermal vessel, one or more recess to define the storage volume for a container, one or more opening configured to define the storage volume and allow the container to be directly immersed in the fluidic transfer medium, and the one or more opening being closeable whereby the thermal exchanger may retain the container and the fluidic transfer medium at any orientation;

the first thermal exchanger and the second thermal exchanger configured to be interchangeable by a coupling of one of the first thermal exchanger or the second thermal exchanger with the engageable fluidic coupling to the thermal source;

the thermal vessel, the flexible thermal vessel and the engageable fluidic coupling are adapted for low pressure transfer of the fluidic transfer medium;

the thermal vessel defines a layered encapsulation around the storage volume, further comprising:

the phase change layer having a phase change material, a thermal transfer layer defined by the thermal transfer chamber, the thermal transfer layer configured for fluidic flow of the fluidic transfer medium between the plurality of ports, and a vacuum layer defined by the vacuum chamber, the vacuum layer having an insulating void for maintaining thermal inertia; and the refrigeration apparatus further comprises a battery configured to power the thermal source and maintain the thermal vessel or the flexible thermal vessel at a temperature range between 4° C. and 10° C. for a period of 10 days.

* * * * *